US006213173B1

(12) United States Patent
Bedi et al.

(10) Patent No.: US 6,213,173 B1
(45) Date of Patent: Apr. 10, 2001

(54) ENGINE AIR PURGE APPARATUS AND METHOD

(75) Inventors: Ram D. Bedi; A. John van der Griendt, both of Bloomfield Hills, MI (US)

(73) Assignee: K. J. Manufacturing Co., Wixom, MI (US)

( * ) Notice: Subject to any disclaimer, the term of this patent is extended or adjusted under 35 U.S.C. 154(b) by 0 days.

(21) Appl. No.: 09/226,698

(22) Filed: Jan. 7, 1999

Related U.S. Application Data

(60) Provisional application No. 60/081,872, filed on Apr. 15, 1998.

(51) Int. Cl.[7] ..... B65B 31/04

(52) U.S. Cl. ..... 141/65; 141/67; 141/95; 184/1.5

(58) Field of Search ..... 141/65, 67, 94, 141/95, 192; 184/1.5

(56) References Cited

U.S. PATENT DOCUMENTS

| | | | | |
|---|---|---|---|---|
| 5,062,398 | | 11/1991 | Bedi et al. | 123/196 R |
| 5,263,445 | | 11/1993 | Bedi et al. | 123/196.005 |
| 5,273,085 | * | 12/1993 | Edwards et al. | 141/83 |
| 5,676,842 | * | 10/1997 | Bedi et al. | 210/739 |

* cited by examiner

*Primary Examiner*—Steven O. Douglas
*Assistant Examiner*—Peter DeVore
(74) *Attorney, Agent, or Firm*—Young & Basile, P.C.

(57) ABSTRACT

An apparatus for changing oil in a vehicle having an internal combustion engine with lubrication passages, the apparatus having a system for air purging the lubrication passages to expediently remove the oil. The apparatus includes a pressure transducer in the fluid line of the air purge system to monitor a pressure drop of the compressed air when the spent oil has been removed from the engine. When the pressure drop exceeds a predetermined value the air purge system automatically deactivates.

11 Claims, 3 Drawing Sheets

ENGINE AIR PURGE APPARATUS AND METHOD

This application claims priority of provisional patent application 60/081,872 filed on Apr. 15, 1998.

FIELD OF THE INVENTION

The invention relates to an apparatus and method for purging engine oil filters and lubricating passages with air during the oil changing procedure of a vehicle. More particularly, this invention relates to a method for sensing and controlling the pressure when air purging the lubrication passages to expediently remove the oil therefrom.

BACKGROUND OF THE INVENTION

The benefits of routine oil changes in an internal combustion engine are well known. Routine oil changes have been shown to increase engine life and performance. With repeated prolonged use, motor oil builds up suspended particles, metallic and non-metallic, from the abrasive and adhesive wear of engine parts against one another and from products of incomplete combustion and improper air intake. The particles in turn cause abrasive wear of the engine bearings, piston rings and other moving parts and the reduction of the motor oil lubricity as various additives and lubricating components become depleted. This adversely affects engine performance and if left unchanged can destroy or cripple the engine performance. It is recommended by at least one oil manufacturer that the level of total solid concentration be limited to levels below 3.0%.

To obtain satisfactory engine performance, and maintain solids concentration levels in the motor oil lower than the recommended 3.0%, changing the motor oil in an internal combustion engine is necessary. In currently designed vehicles, the oil pan serves the purpose of a reservoir for circulation of engine oil. Engine lubrication is generally accomplished through a gear-type pump. Oil from the pump passes through the oil filter before going to the engine oil galleries from where it provides lubrication to the various engine components.

To remove the contaminated oil, the drain plug, generally located in the lowermost region of the oil pan, is opened. The spent oil containing suspended particles is permitted to flow under gravity out of the pan into a suitable receptacle. After the spent oil is removed, the plug is replaced and fresh oil is added to the engine through a separate opening in the engine valve cover. The process of gravity drainage does not remove all of the spent oil with its metallic and non-metallic particles which stick to the oil pan container walls, as well as engine components such as the crank shaft, connecting rods, pistons and the like which are exposed to the motor oil spray lubrication. These particles remain to be mixed with fresh motor oil Thus the concentration of contaminants is lowered by dilution and only a part of the total contaminates are actually eliminated.

Therefore, it would be desirable to provide a method which removes spent oil more completely and easily from the internal combustion engine. It would also be desirable to provide a system which reduces the amount of spent oil handling as required in the conventional oil change service method.

It is further desirable to provide an automated system that includes a source of compressed air and a means for supplying the compressed air for purging fluid from the internal combustion engine. It is finally desirable to provide a means for automatically sensing and controlling the air pressure inside the crankcase as well as deactivating the compressed air at a predetermined time to prevent over pressurizing of the crankcase and thereby adversely affecting the seals.

SUMMARY OF THE INVENTION

The present invention includes an apparatus for changing oil that is external and separable from the internal combustion engine. The external device would be operably connectible to fresh oil storage means and waste oil storage means. The external apparatus preferably includes air purge means for purging fluid retained within the oil filter and any fluid remaining in the lubrication system passages of the internal combustion engine, such that all waste fluid can be deposited within the oil pan reservoir. The pump means of the external apparatus draws waste fluid from the oil pan reservoir for deposit in the appropriate waste storage means.

In operation, the present invention provides a method for quickly and efficiently removing waste oil from an internal combustion engine and replenishing the lubrication system of the internal combustion engine with fresh oil. Additionally, the present invention provides purging of fluid from the oil filter and lubrication passages of the internal combustion engine with pressurized air means. The current invention provides a means for deactivating the compressed air after purging the engine oil filter and lubrication passages of liquid in order to prevent overpressurizing of the crankcase.

The means for deactivating the air purge includes a computer monitored program. The computer monitors the air pressure leaving the oil changing apparatus. When the purged air initially enters the oil filter and lubrication passages, there will be resistance and a corresponding back pressure due to the fact that the filter and passages are still full of oil. This initial back pressure is averaged over the first few seconds and this becomes the average base pressure. The purge air pressure gradually forces the oil out of the filter and passages into the oil pan. As the passages are being cleared, the resistance will decrease, resulting in a corresponding drop in back pressure. At the same time the air will enter the crankcase, which may result in the build up of pressure inside the crankcase. Crankcases are typically equipped with positive crankcase ventilation devices (PCV valves), which prevent overpressurizing of the crankcase, which may cause seals to fail, resulting in loss of lubricating oil. It is desirable however to have an additional safeguard to prevent pressure buildup resulting from the purge air entering the crankcase, in case of malfunction of the PCV device. The present invention monitors the back pressure of the purge air and deactivates the flow of purge air when the pressure drop exceeds a certain predetermined value from the average base pressure. Thus the present invention will ensure the completion of the purging of the oil filter and passages, while preventing undesirable pressure build up inside the crankcase.

Other modifications, characteristics, features and benefits of the present invention will become apparent upon reading the following detailed description of the invention in conjunction with the attached drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
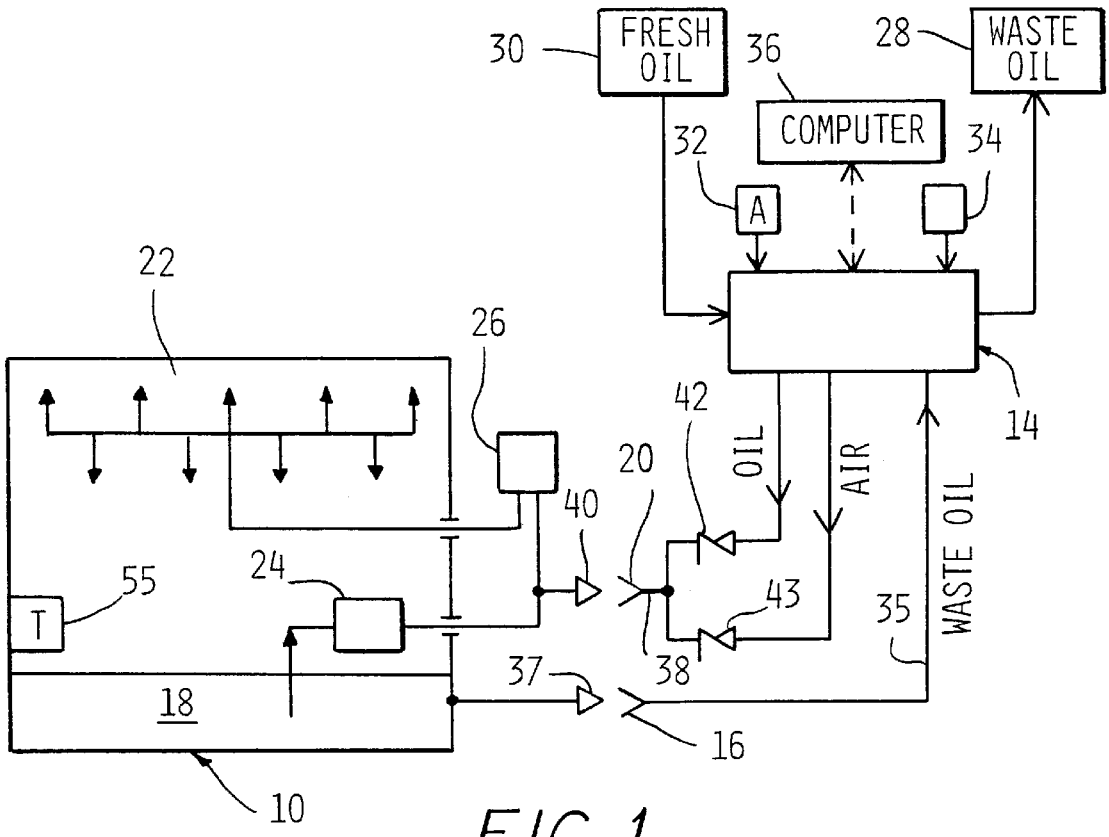
FIG. 1 is a schematic view of an oil change apparatus incorporating the air purge pressure sensing and control apparatus of the present invention.

In an oil changing apparatus such as disclosed in U.S. Pat. No. 5,062,398 issued to the subject inventors and incorporated herein by reference, one or more coupling connections from the apparatus 14 may be connected to the internal combustion engine 10 to facilitate proper connection of the external oil changing apparatus 14 to the lubrication system of the engine 10. In the broadest sense, one coupling connection 16 will be in fluid communication with the lowermost portion of the oil pan reservoir 18 for draining the spent and waste oil therefrom. A second coupling connection 20 will be located in fluid communication with the internal oil lubrication distribution passage system 22, preferably between the oil pump 24 and the oil filter element 26. Preferably both coupling connections 16, 20 will be provided with quick connect couplings as is conventional and known in the art. The oil changing apparatus 14 is connectible to a plurality of external storage means. Storage means includes a waste oil storage receptacle 28 and a fresh motor oil supply receptacle 30. The oil changing apparatus 14 also includes a connection to a source of compressed air 32, an electrical connection to a power source 34 and connection to a computer or control module 36. The connection to the source of compressed air 32 is controlled by appropriate valve means for opening and closing the communication of the compressed air with the oil changing apparatus 14. The oil changing apparatus 14 further includes pump means (not shown) for evacuating fluid from the internal combustion engine 10 and pump means for introducing fluid into the internal oil lubrication distribution passage system 22 of the internal combustion engine 10.

In operation the internal combustion engine 10 is brought into proximity with the oil changing apparatus 14. A fluid conduit hose 35 having a preferably quick connect coupling 16 is connected to the appropriate outlet connection 37 of the internal combustion engine 10 for drawing fluid from the reservoir of the internal combustion engine. A second hose 38 with a second preferably quick connect coupling is connected to the appropriate connection 40 of the internal combustion engine 10 for introducing fluid into the internal combustion engine 10 through the filter 26 and the internal oil lubrication distribution passage system 22 of the internal combustion engine 10 for subsequent accumulation in the oil pan reservoir 18 of the internal combustion engine 10.

Figure 3:
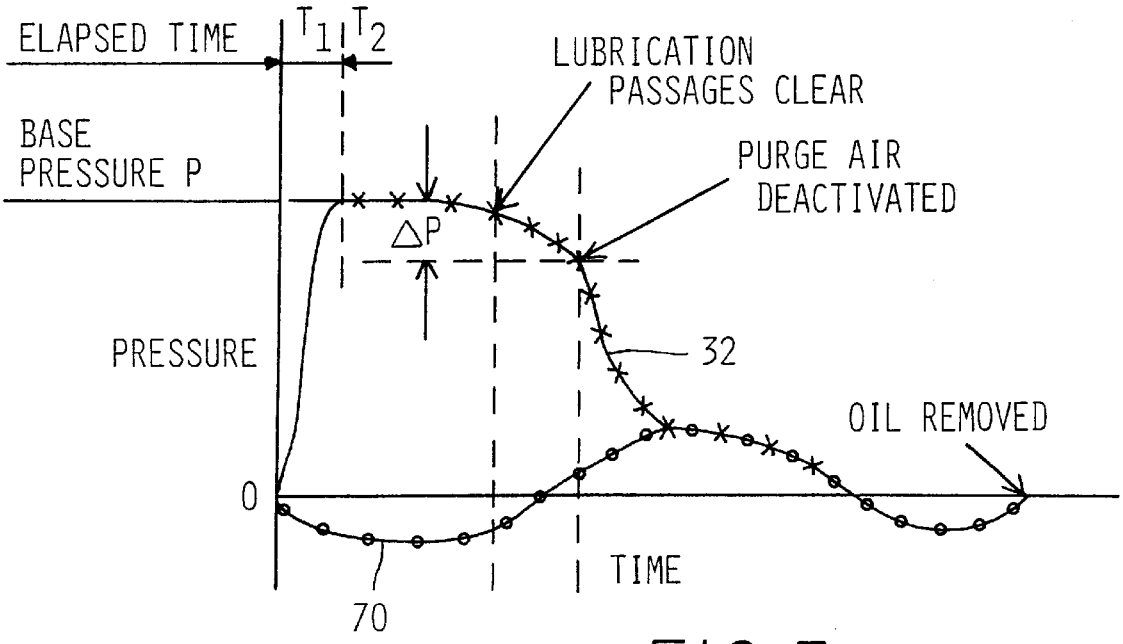
FIG. 3 is a graph of the relationship of compressed air pressure and crankcase pressure during the air purge procedure.
Figure 4:
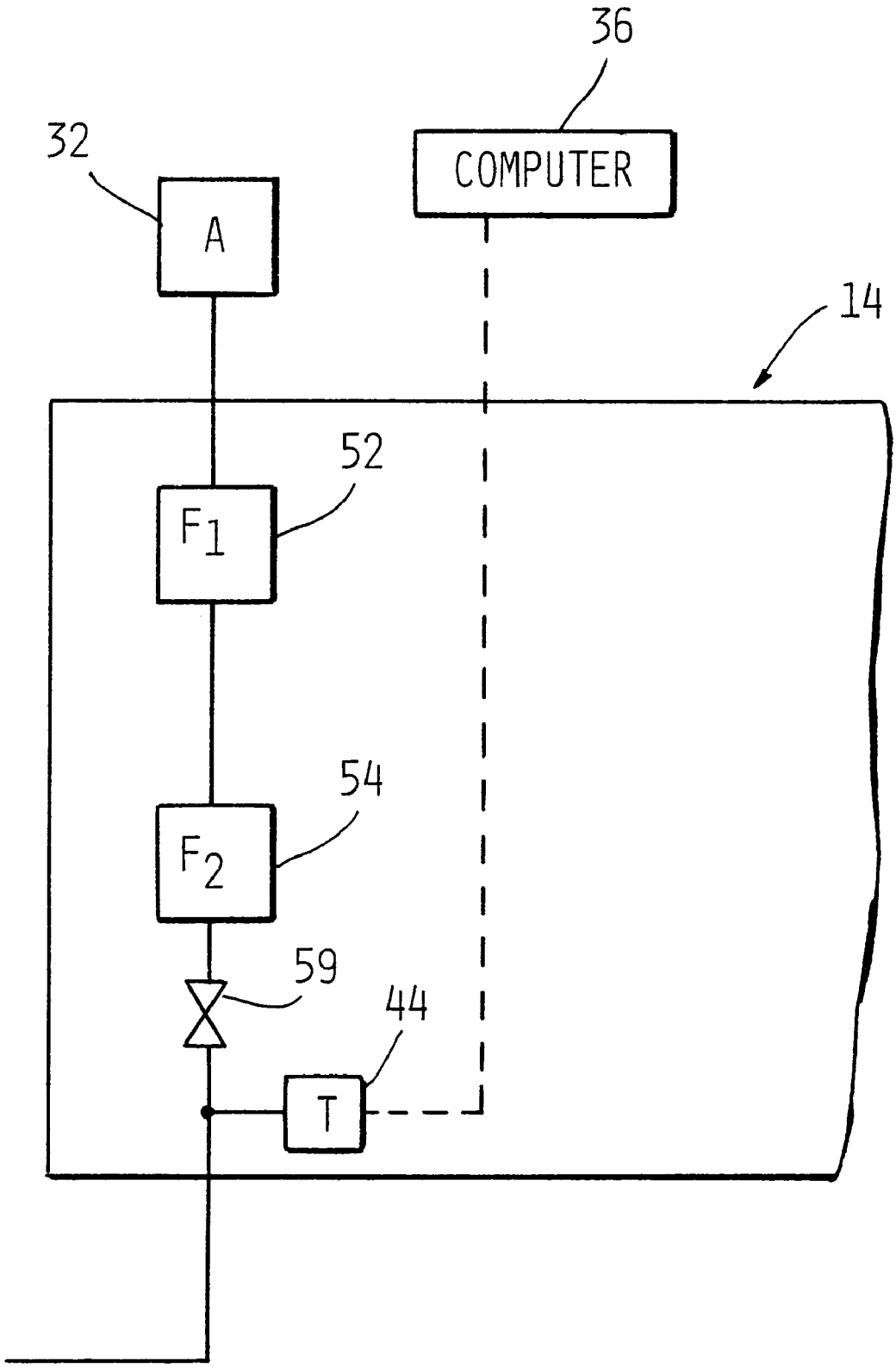
FIG. 4 is a schematic view of the air purge system of the current invention in the oil change apparatus.

Pump means is energized to draw fluid from the oil pan reservoir 18 of the internal combustion engine 10 for discharge into the spent/waste oil storage receptacle 28. At the same time, a control valve 59 (FIG. 4) is energized to provide flow and actuation of pressurized air 32 into the system to purge fluid from the oil filter 26 and lubricating passages 22 thereby causing the residual spent oil retained within the filter and lubricating passages 22 to be discharged 22 to the oil pan reservoir 18 of the internal combustion engine 10. Various filters 52, 54 are provided to ensure that the pressurized air 32 is clean and moisture is removed therefrom. Check valve 42 in the fresh oil line prevents air from entering into the oil line during the purge process and check valve 43 in the purge air prevents oil from entering into the air line during the oil replenishing process. Air forces oil out of the oil filter and lubricating passages 22 by the compressed air 32 prior to being deposited in the oil pan reservoir 18 of the internal combustion engine 10. Currently, the compressed air 32 is deactivated after a predetermined time monitored by the computer 36. The improvement of the current invention to the oil changing apparatus as described with more detail in U.S. Pat. No. 5,062,398 is to provide an alternative means and method for determining when to deactivate the air purge system by anticipating or measuring the pressure in the crankcase 18. A general relationship of the compressed air pressure and the crankcase pressure during the oil evacuation and compressed air purge portion of the oil changing procedure is shown in FIG. 3. Initially during the evacuation portion, the crankcase pressure 70 is negative or is a vacuum. The compressed air purge pressure at the oil change apparatus 14 is a relative constant pressure predetermined by the operator. When the purge air has cleared the engine oil filter and lubrication passages, the purge air enters the crankcase, and the compressed air pressure at the oil changing apparatus drops. At the same time the air entering the crankcase may cause the pressure of the crankcase to increase. To prevent overpressurizing of the crankcase which can adversely affect the engine seals, the compressed air pressure should be deactivated before the crankcase pressure rises to an unacceptable level. One method to determine this event is to provide a pressure transducer 55 located in the oil reservoir 18 that can be monitored for crankcase pressure. When the crankcase pressure reaches a certain predetermined level, the compressed air pressure can be deactivated. The transducer 55 in the oil reservoir 18 therefore requires an electrical connection from the transducer 55 to the oil changing apparatus 14 so that the computer 36 of the oil change apparatus 14 can monitor the crankcase pressure to determine when to deactivate the compressed air. When the crankcase pressure reached a predetermined value the computer 36 would deactivate the compressed air 32.

Another method is to provide a look-up table in the computer 36 so that based upon certain parameters such as engine, size vehicle model, etc. the air compressor is deactivated after a predetermined time interval. Each parameter will have a specific time interval assigned based upon previous test data which included monitoring of crankcase pressure. It is also conceivable to provide a single time interval for all parameters. The time interval will be an amount that would be safe for even the smallest engine. A clock in the computer will count down the time and the computer would deactivate the air purge when the time on the clock equals zero. Although, this method would not optionally discharge all of the residual spent oil through the internal oil lubrication distribution passage system, the added spent oil discharged into the oil reservoir would significantly lower the concentration of contaminants mixed with the fresh oil.

Figure 2:
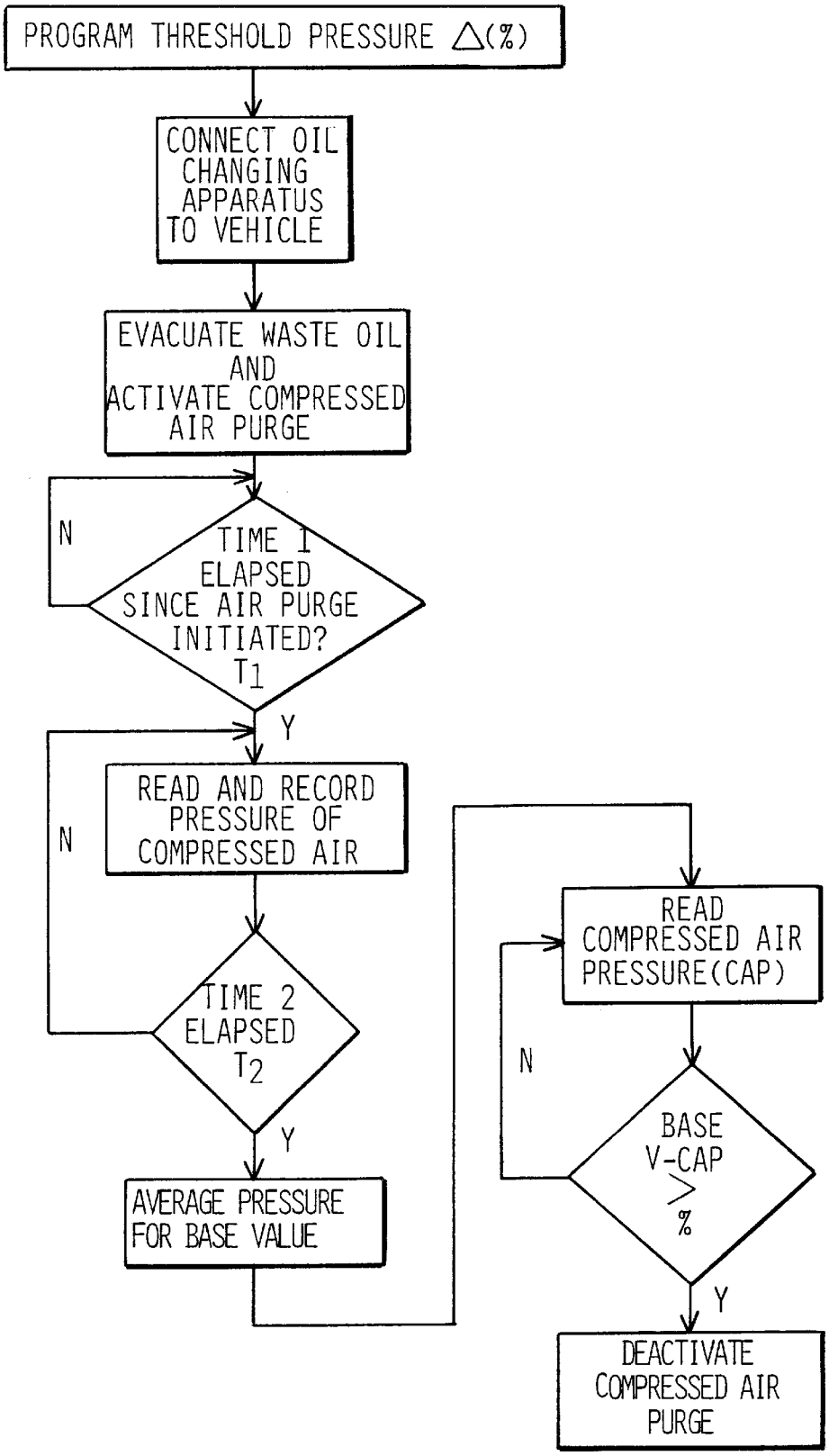
FIG. 2 is a flow chart of the method for sensing and controlling the air purge pressure during the oil change procedure.

An alternative and preferred method as shown in FIG. 2, is to use the relationship of the crankcase pressure and the compressed air pressure as shown in FIG. 3 such that a transducer 44 is put in line of the air purge system of the oil changing apparatus 14 (FIG. 4) to monitor the pressure drop of the compressed air when the spent oil has been removed from the engine 10. Therefore the improved method includes activating the pump to draw fluid from the oil pan reservoir 18 of the internal combustion engine 10 for discharge into the spent oil storage receptacle and activating the delivery of the compressed air by activating valve 59. Initially there is a short time elapse "$T_1$" before the compressed air reaches the full pressure "P" when entering the internal combustion engine 10. After this elapsed time "$T_1$", the transducer 44 monitors the pressure of the compressed air over a very short interval of time "$T_2$", and takes multiple pressure readings during the short interval. The multiple pressure readings are then averaged. This average will provide a base value for the initial pressure of the compressed air "P". A percentage threshold pressure drop AP of the compressed air will have been previously determined to indicate that the spent oil has been removed from the oil filter and passages and that the crankcase pressure may start to rise.

After the base value pressure "P" has been established, the compressed air 32 will be continually read and monitor at specified intervals while the engine 10 is being purged of oil. The monitored air pressure 32 will be compared to the base value air pressure and determined whether the difference exceeds the percentage threshold pressure drop ΔP. When the percentage threshold pressure drop has been met or exceeded, the oil changing apparatus 14 will automatically deactivate the compressed air purge. The percentage threshold pressure drop ΔP may have been calculated from previous test data, which closely monitored the relationship of pressure in the air purge system with crankcase pressure. The percentage threshold pressure drop ΔP may be a single value for all engines and vehicles or may be a unique value for each engine configuration.

After the oil pan reservoir 18 of the internal combustion engine 10 has been emptied, and the compressed air purge has been deactivated, the filter element 26 of the internal combustion engine 10 can be removed and replaced with a clean filter element 26. Fresh oil can then be introduced into the internal oil lubrication distribution passage system 22 by actuating a directional control valve (not shown) to allow flow to draw fresh motor oil from the fresh oil supply receptacle 30 for discharge into the internal combustion engine through the oil filter element 26 and internal oil lubrication distribution passage system 22 for accumulation in the oil pan reservoir 18 of the internal combustion engine 10. When an adequate amount of fresh motor oil has been delivered to the internal combustion engine the quick disconnect couplings are disconnected from the internal combustion engine. The internal combustion engine 10 is now ready for normal use with the oil filter element being precharged with fresh oil and engine components prelubricated prior to starting the engine.

While the invention has been described in detail, it will be apparent to those skilled in the art that the disclosed invention may be modified. Therefore, the foregoing description is to be considered exemplary, rather than limiting and the true scope of the invention is that defined in the following claims.

What is claimed is:

1. An apparatus for changing oil in an internal combustion engine having an internal oil lubrication distribution passage system with an oil filter , a crankcase and an oil reservoir, the apparatus comprising:

means for purging fluid from said oil filter into said oil reservoir;

means for removing fluid from said oil reservoir;

means for monitoring the pressure in the crankcase and preventing overpressurization of the crankcase when purging fluid from said oil filter into said oil reservoir; and means for introducing fluid into said oil reservoir through said oil filter and internal oil lubrication distribution passage system, wherein said fluid purging means includes a source of compressed air, fluid passage means interconnecting the source of compressed air with said internal oil lubrication distribution passage system at a position upstream of said oil filter, valve means for controlling communication of the source of compressed air with said internal oil lubricating distribution passage system, means for activating and deactivating the valve means for controlling communication of the source of compressed air, and means for sensing when to deactivate the valve means.

2. The apparatus of claim 1, wherein the sensing means includes a computer in communication with the apparatus and a time interval stored in the computer for communicating the source of compressed air with said internal oil lubrication distribution passage system wherein when the time interval has elapsed, the valve means is deactivated.

3. The apparatus of claim 2, wherein the time interval is based on at least one of the type of vehicle and the type of engine.

4. The apparatus of claim 1, wherein the sensing means includes means to sense a pressure drop in the fluid passage means.

5. The apparatus of claim 4, wherein the means to sense a pressure drop in the fluid passage means includes a transducer in the purging fluid means.

6. The apparatus of claim 1, wherein means for monitoring the pressure in the crankcase and preventing overpressurization of the crankcase when purging fluid from the oil filter includes a means for detecting a pressure rise in the crankcase by detecting a pressure drop of the compressed air while purging fluid from said oil filter into said oil reservoir.

7. The apparatus of claim 6, wherein said means for sensing when to deactivate the valve means includes a pressure transducer located downstream from the source of compressed air for monitoring the pressure of the compressed air.

8. The apparatus of claim 1, wherein means for monitoring the pressure in the crankcase and preventing over pressurization of the crankcase when purging fluid from the oil filter further includes means for determining a percentage threshold pressure drop of the compressed air.

9. The apparatus of claim 8, wherein means for monitoring the pressure in the crankcase and preventing over pressurization of the crankcase when purging fluid from the oil filter further includes means for comparing the pressure drop of the compressed air with the percentage threshold pressure drop.

10. An apparatus for changing oil in an internal combustion engine having an internal oil lubrication distribution passage system with an oil filter and an oil reservoir, the apparatus comprising:

means for purging fluid from said oil filter into said oil reservoir;

means for removing fluid from said oil reservoir; and means for introducing fluid into said oil reservoir through said oil filter and internal oil lubrication distribution passage system, wherein said fluid purging means includes a source of compressed air, fluid passage means interconnecting the source of compressed air with said internal oil lubrication distribution passage system at a position upstream of said oil filter, valve means for controlling communication of the source of compressed air with said internal oil lubrication distribution passage system, means for activating and deactivating the valve means for controlling communication of the source of compressed air, and means for sensing when to deactivate the valve means, wherein the sensing means includes a pressure transducer located in the oil reservoir for monitoring pressure in the crankcase.

11. The apparatus of claim 10, further including a computer, wherein the pressure transducer communicates with said computer.

* * * * *